US005460548A

United States Patent [19]

Roth

[11] Patent Number: 5,460,548

[45] Date of Patent: Oct. 24, 1995

[54] PLUG-IN CONNECTOR

[75] Inventor: Michael Roth, München, Germany

[73] Assignee: Siemens Aktiengesellschaft, Munich, Germany

[21] Appl. No.: 293,836

[22] Filed: Aug. 22, 1994

[51] Int. Cl.[6] ..... H01R 13/64

[52] U.S. Cl. ..... 439/680; 439/374

[58] Field of Search ..... 439/680, 681, 439/374, 377

[56] References Cited

U.S. PATENT DOCUMENTS

| | | | |
|---|---|---|---|
| 4,376,565 | 3/1983 | Bird et al . | 439/681 |
| 4,726,791 | 2/1988 | Rudy, Jr. et al. | 439/677 |
| 5,370,556 | 12/1994 | Olsson | 439/680 |

FOREIGN PATENT DOCUMENTS 8714016 1/1988 Germany .

*Primary Examiner*—Gary F. Paumen
*Attorney, Agent, or Firm*—Herbert L. Lerner; Laurence A. Greenberg

[57] ABSTRACT

A plug-in connector includes a trough-shaped socket unit and a plug unit to be fittingly inserted into the socket unit. The socket unit has a plug channel with an elongated, approximately rectangular cross section, longer longitudinal side walls and shorter transverse side walls defining the plug channel, an inner end with a bottom closing off the plug channel, and a multiplicity plug pins protruding at right angles from the bottom. The longitudinal side walls have guide segments and recesses. The plug unit has a substantially rectangular cross section with longitudinal lateral surfaces, transverse lateral surfaces and a front closure surface having insertion openings formed therein for passage of the plug pins through the insertion openings to plug sockets. The transverse lateral surfaces are guided along the transverse side walls and the longitudinal lateral surfaces are guided on the guide segments. Both of the longitudinal lateral surfaces have respective opposed safety ribs extending in an insertion direction in the vicinity of two end edges. The longitudinal side walls have complementary safety grooves in the vicinity of two end edges for receiving the safety ribs. The opposed safety ribs define a width of the plug unit greater than a greatest clear opening defined between the recesses.

5 Claims, 2 Drawing Sheets

PLUG-IN CONNECTOR

BACKGROUND OF THE INVENTION

FIELD OF THE INVENTION

The invention relates to an electric plug-in connector, including a trough-shaped socket unit and a plug unit being fittingly insertable into the socket unit; the socket unit having a plug channel with an elongated, approximately rectangular cross section being defined by longer longitudinal side walls and shorter transverse side walls and being closed off at an inner end thereof by a bottom from which a multiplicity of plug pins protrude at right angles; the plug channel of the socket unit having recesses in the longitudinal side walls defining a clear opening or enlarged internal diameter approximately in a middle region; the plug unit having a substantially rectangular cross section with longitudinal lateral surfaces, transverse lateral surfaces and a front closure surface in which insertion openings are formed for the passage of the plug pins therethrough to plug sockets located behind them; the transverse lateral surfaces being guided along the transverse side walls and the longitudinal lateral surfaces being guided on guide segments of the longitudinal side walls, upon insertion of the plug unit into the socket unit; respective safety ribs extending in the insertion direction in the vicinity of two end edges on both longitudinal lateral surfaces of the plug unit; and complementary safety grooves being formed in the longitudinal side walls of the socket unit in the vicinity of two end edges for receiving the safety ribs.

Such a plug-in connector is known from U.S. Pat. No. 4,376,565.

In multiple-plug connectors it is known to provide encoding in a plug housing to prevent them from being plugged in the wrong way. To that end, an encoding rib is formed onto one part, for instance the plug unit, while a complementary encoding groove is provided in the respectively other part, in that case the socket unit. In such a case, the plug unit can be introduced into the socket unit only with a predetermined alignment, on the condition that the latter has a corresponding encoding groove.

However, such encoding merely prevents the two plug units from being inserted all the way into one another with their alignment reversed or with different encoding, which would produce incorrect electrical connections. However, often the encoding cannot prevent the plug unit from being introduced partway into the plug channel. In particular, if an encoding rib is mounted on one end of the plug unit, the other end of the plug unit can be pressed crooked into the plug channel, where it will damage or bend the plug pins. That may conceivably happen, for instance, when the plug is installed in poorly accessible places with poor visibility, such as inside motor vehicles. Introducing the plug unit into the plug channel crookedly by mistake can cause the aforementioned damage to the plug pins, which in turn entails expensive repair work involving replacement of the parts.

SUMMARY OF THE INVENTION

It is accordingly an object of the invention to provide a plug-in connector, which overcomes the hereinafore-mentioned disadvantages of the heretofore-known devices of this general type and which does so in such a way that mistaken crooked insertion and therefore damage to plug pins is reliably precluded.

With the foregoing and other objects in view there is provided, in accordance with the invention, a plug-in connector, comprising a trough-shaped socket unit and a plug unit to be fittingly inserted into the socket unit in a given insertion direction; the socket unit having two end edges, a plug channel with an elongated, approximately rectangular cross section and a middle region, longer longitudinal side walls and shorter transverse side walls defining the plug channel, an inner end with a bottom closing off the plug channel, and a multiplicity plug pins protruding at right angles from the bottom; the longitudinal side walls having recesses formed therein defining a given greatest clear opening or enlarged internal diameter approximately in the middle region of the the plug channel, and the longitudinal side walls having guide segments formed thereon; the plug unit having a substantially rectangular cross section with longitudinal lateral surfaces, transverse lateral surfaces, a front closure surface and two end edges, the front closure surface having insertion openings formed therein for passage of the plug pins through the insertion openings to plug sockets located behind them, the transverse lateral surfaces being guided along the transverse side walls and the longitudinal lateral surfaces being guided on the guide segments, upon insertion of the plug unit into the socket unit; both of the longitudinal lateral surfaces of the plug unit having respective opposed safety ribs being formed thereon and extending in the given insertion direction in the vicinity of the two end edges; the longitudinal side walls of the socket unit having complementary safety grooves formed therein in the vicinity of the two end edges for receiving the safety ribs; and the opposed safety ribs defining a width of the plug unit being greater than the given greatest clear opening of the plug channel between the recesses.

In other words, if over-wide safety ribs are provided in the two end regions of the longitudinal sides of the plug unit, which protrude past the clear opening or internal diameter of the plug channel in each of its regions, then any incorrect insertion, including crooked introduction of an end edge, is precluded in accordance with the invention. This embodiment according to the invention is especially significant in the event that the plug channel of the socket unit has an enlarged clear opening or internal diameter approximately in the middle region, because of recesses in the longitudinal side walls. This is provided, for instance, in the plug-in connector of German utility DE-U 87 14 016, for the purpose of placing devices for locking the plug-in connector in an enlarged gap between the plug unit and the socket unit. In other words, in such a case, if the locking devices are mounted on the plug unit, and the plug channel of the socket unit has relatively large recesses in its middle region, then there is a very great danger that a crookedly inserted plug unit can be introduced relatively far in this middle region of the plug channel and may even reach the level of recessed plug pins.

In accordance with another feature of the invention, if free ends of the plug pins are spaced a certain safety margin away from and underneath a closure edge of the side walls of the socket unit, then the safety ribs may be recessed from the front closure surface of the plug unit by a distance that is less than the safety margin of the plug pins. This recessing of the safety ribs assures that the corresponding safety grooves in the longitudinal lateral surfaces of the socket unit only need to be guided to a lesser extent into the depth of the plug channel. The relatively deep safety grooves thus only slightly reduce the stability of the socket unit.

In accordance with a further feature of the invention, the safety ribs of one lateral surface each have a different spacing relative to the end edges of these lateral surfaces. Thus the safety ribs attain a kind of additional encoding to prevent incorrect polarization even when the plug is inserted straight.

In accordance with an added feature of the invention, at least some of the safety ribs are formed onto an encoding rib in the form of protrusions.

In accordance with a concomitant feature of the invention, at least some of the safety ribs are formed onto a closure plate slipped onto the plug unit.

Other features which are considered as characteristic for the invention are set forth in the appended claims.

Although the invention is illustrated and described herein as embodied in a plug-in connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
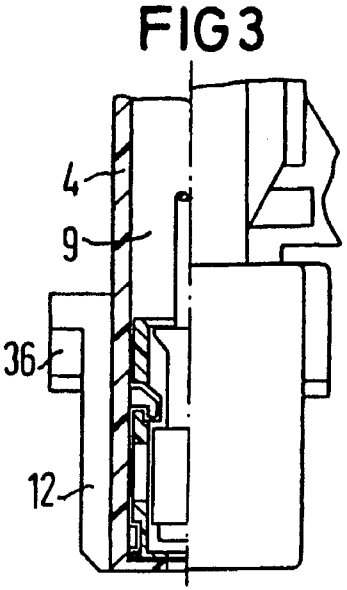
FIG. 3 is a fragmentary, longitudinal-sectional view of the plug unit, which is taken along the line III—III of FIG. 2, in the direction of the arrows.
Figure 1:
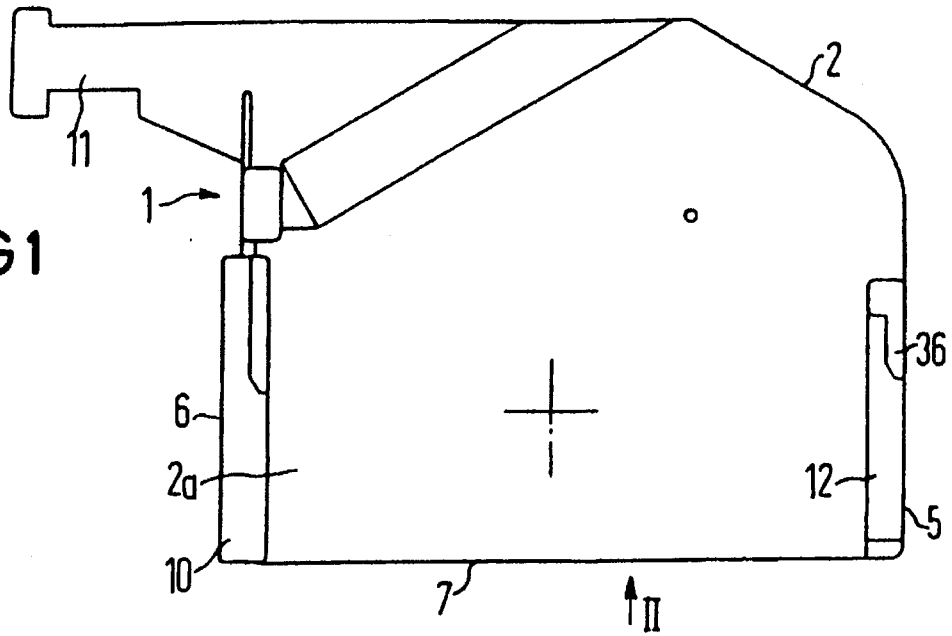
FIG. 1 is a diagrammatic, side-elevational view of a plug unit.
Figure 2:
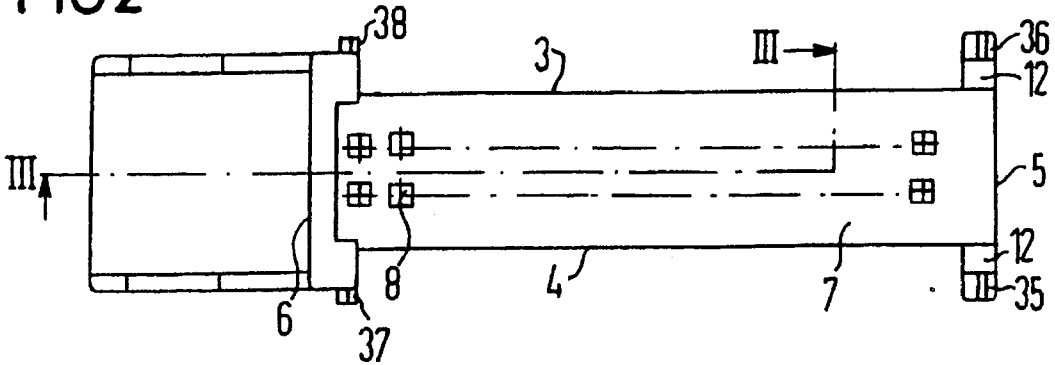
FIG. 2 is a bottom-plan view of the plug unit, as seen in the direction of the arrow II in FIG. 1.

Referring now to the figures of the drawing in detail and first, particularly, to FIGS. 1–3 thereof, there is seen a plug unit 1 which has a housing 2 that has a substantially rectangular cross section, at least in a lower portion 2*a* thereof. The lower portion 2*a* is defined at an outer periphery by longitudinal sides 3 and 4 and transverse sides 5 and 6. A front end, in terms of a plug insertion direction, is defined by a closure surface 7 that has a number of insertion openings 8, only a few of which are suggested in FIG. 2. The housing 2 has an interior with a hollow chamber 9 into which socket strips can be thrust, from the left in FIG. 1. The socket strips have plug sockets each being disposed behind a respective one of the insertion openings 8. An introduction opening for the socket strips is closed off in the present example by a closure plate 10 that can be slipped on. A cable supply channel 11 is also formed onto the top of the plug unit 1. The plug unit also has an encoding rib 12, that is known per se, on one end.

Figure 4:
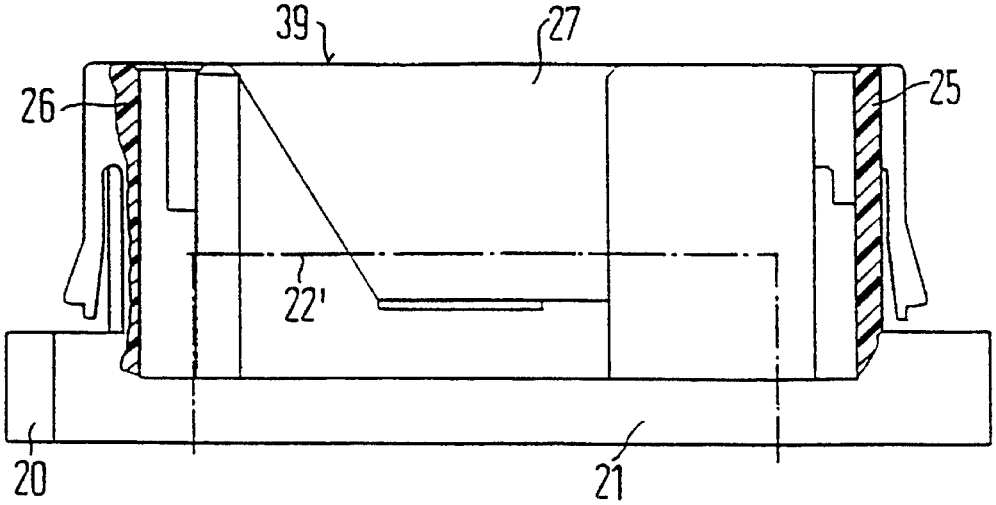
FIG. 4 is a longitudinal-sectional view of a socket unit, which is taken along the line IV—IV of FIG. 5, in the direction of the arrows.
Figure 5:
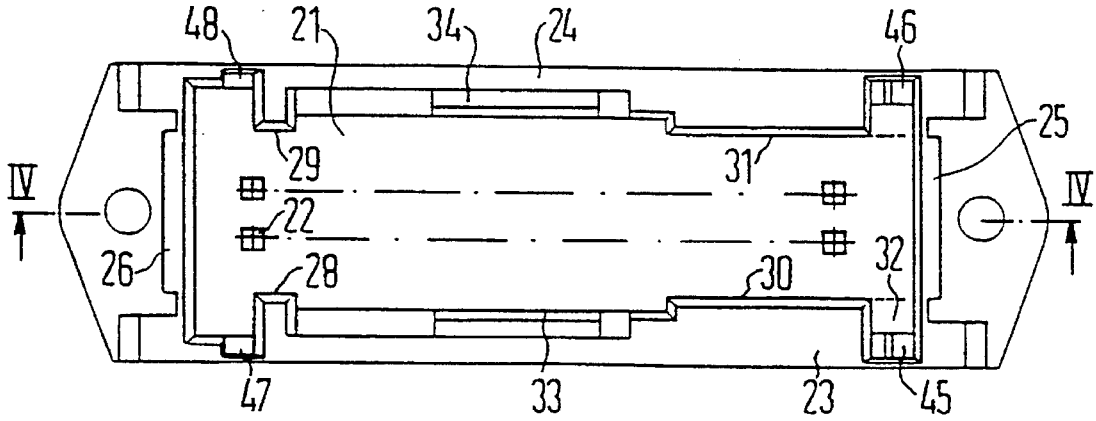
FIG. 5 is a bottom-plan view of the socket unit.

A socket unit 20 shown in FIGS. 4 and 5 has a housing bottom 21 that has a number of plug pins 22, only a few of which are suggested in FIG. 5. The height of the plug pins 22 is represented in FIG. 4 by dot-dashed lines 22'. The plug pins 22 are enclosed by an encompassing collar of the socket unit, which is formed by two longitudinal side walls 23 and 24 and two transverse side walls 25 and 26. These walls thus form a plug channel 27 into which the plug unit 1 can be inserted. In the insertion process, the plug unit 1 is guided with its transverse lateral surfaces 5 and 6 along the transverse side walls 25 and 26, and with its longitudinal lateral surfaces 3 and 4 along guide segments 28, 29, 30 and 31 of the socket unit 20. Encoding grooves 32 which are provided in the socket unit 20 correspond to the encoding ribs 12 in the plug unit 1, so that even with a vertical insertion and a correct alignment, only the proper plug unit can be introduced into the socket unit.

Since the encoding rib is located only on the right-hand side of the drawing in the example shown, it does not prevent an incorrect, crooked insertion of the plug unit which leads with the left-hand end edge as seen in the drawing. Although the plug unit naturally cannot then be inserted all the way, nevertheless the plug pins 22 can be damaged. This is all the more true for the example shown since a recess 33 is provided in the longitudinal side wall 23 between the guide segments 28 and 30 and a recess 34 is provided in the longitudinal side wall 24 between the guide segments 29 and 31, in the socket unit. These recesses create space for a non-illustrated locking device between the socket unit and the plug unit. In that case, the plug unit could even be inserted with the coding ribs 12 leading and crooked.

In order to prevent such a crooked insertion, additional safety ribs 35, 36, 37, and 38 are formed onto each side of the end regions of the longitudinal side walls 3 and 4 of the plug unit. Through the use of these ribs, the plug unit is given a width on the ends that in each case is greater than the greatest clear opening or internal diameter of the plug channel 27 between the recesses 33 and 34. Corresponding safety grooves 45, 46, 47 and 48 in the socket unit are associated in complementary fashion with the aforementioned safety ribs 35, 36, 37, 38. As can be seen from FIG. 2, the safety ribs 35 and 36 on one end of the plug unit and the safety ribs 37 and 38 on the other end of the plug unit each have a different, slight spacing from the respective end edge or from the respective transverse lateral surfaces 5 and 6. Thus they assure that the plug unit cannot be inserted vertically after being rotated by 180°.

Since the additional safety grooves 45, 46, 47 and 48 reduce the thickness of the wall of the receiving part in the vicinity thereof, it is desirable for these grooves not to be made overly deep. For that reason, in the present example the safety ribs 35–38 are not extended as far as the closure surface 7 but rather are recessed by a certain spacing distance, and thus the safety grooves 45–48 need not be very deep, either. However, this spacing of the recessed safety ribs must not be any greater than the spacing between an upper closure edge 39 of the side walls 23 and 24 and the upper ends of the plug pins 22, which are suggested by the dot-dashed line 22' in FIG. 4. This assures that even though the plug unit can be inserted crooked to a certain depth, nevertheless it cannot endanger the plug pins 22.

I claim:

1. A plug-in connector, comprising:

a trough-shaped socket unit and a plug unit to be fittingly inserted into said socket unit in a given insertion direction;

said socket unit having two end edges, a plug channel with an elongated, approximately rectangular cross section and a middle region, long longitudinal side walls and short transverse side walls defining said plug channel, an inner end with a bottom closing off said plug channel, and a multiplicity of plug pins protruding at right angles from said bottom;

said longitudinal side walls having recesses formed therein defining a first width therebetween approximately in said middle region of said plug channel, and said longitudinal side walls having guide segments formed thereon;

said plug unit having a substantially rectangular cross section with longitudinal surfaces, transverse surfaces, a front closure surface and two end edges, said front closure surface having insertion openings formed therein for passage of said plug pins through said insertion openings to plug sockets, said transverse surfaces being guided along said transverse side walls and said longitudinal surfaces being guided on said guide segments, upon insertion of said plug unit into said socket unit;

both of said longitudinal surfaces of said plug unit having respective opposed safety ribs being formed thereon and extending in said given insertion direction in the vicinity of said two end edges;

said longitudinal side walls of said socket unit having complementary safety grooves formed therein in the vicinity of said two end edges for receiving said safety ribs; and said opposed safety ribs defining a second width of said plug unit being greater than said first width of said plug channel between said recesses so that said safety ribs cannot be inserted into said recesses.

2. The plug-in connector according to claim 1, wherein said side walls of said socket unit have a closure edge, said plug pins have free ends disposed at a given safety margin away from and behind said closure edge, and said safety ribs are recessed from said front closure surface of said plug unit by a distance being less than said given safety margin.

3. The plug-in connector according to claim 1, wherein said longitudinal surfaces of said plug unit have end edges, and each of said safety ribs of one of said longitudinal surfaces have a different spacing from said end edges of said longitudinal surfaces.

4. The plug-in connector according to claim 1, including an encoding rib, at least some of said safety ribs being protrusions on said encoding rib.

5. The plug-in connector according to claim 1, including a closure plate slipped onto said plug unit, at least some of said safety ribs being formed onto said closure plate.

* * * * *

UNITED STATES PATENT AND TRADEMARK OFFICE

CERTIFICATE OF CORRECTION

PATENT NO. : 5,460,548

DATED : October 24, 1995

INVENTOR(S) : Michael Roth

It is certified that error appears in the above—identified patent and that said Letters Patent is hereby corrected as shown below:

On the title page, after "Filed" insert on a separate line

-- [30] Foreign Application Priority Data --

-- February 21, 1992 (DE) Germany .....92 02 281.2 --

Signed and Sealed this

Thirtieth Day of April, 1996

Bruce Lehman

*Attest:*

BRUCE LEHMAN

*Attesting Officer*

*Commissioner of Patents and Trademarks*